United States Patent [19]

Tuma

[11] Patent Number: 4,986,163

[45] Date of Patent: Jan. 22, 1991

[54] SLIDE ARRESTING DEVICE AT A HANDGUN

[75] Inventor: Martin Tuma, Solothurn, Switzerland

[73] Assignees: ITM Industrial Technology & Machines AG; Sphinxwerker Muller AG, both of Solothurn, Switzerland

[21] Appl. No.: 460,769

[22] Filed: Jan. 4, 1990

[51] Int. Cl.[5] ..... F41A 11/00

[52] U.S. Cl. ..... 89/196

[58] Field of Search ..... 42/75.01, 75.02; 89/163, 196

[56] References Cited

U.S. PATENT DOCUMENTS 4,681,020 7/1987 Polansky ..... 89/196

*Primary Examiner*—Stephen C. Bentley

*Attorney, Agent, or Firm*—Ladas & Parry

[57] ABSTRACT

An arrresting pin having a recessed circumferential section is inserted in the frame of the gun. A pin locking spring is biased into the mentioned recess. This locking spring prevents the arresting pin from falling out of the frame. A simple rotation of the arresting pin moves the locking spring out of the way, allowing an easy disassembling. The arresting pin includes further a planar jacket section, co-operating with a corresponding abutment surface at the slide for limiting the travel during the recoil of the slide.

2 Claims, 1 Drawing Sheet

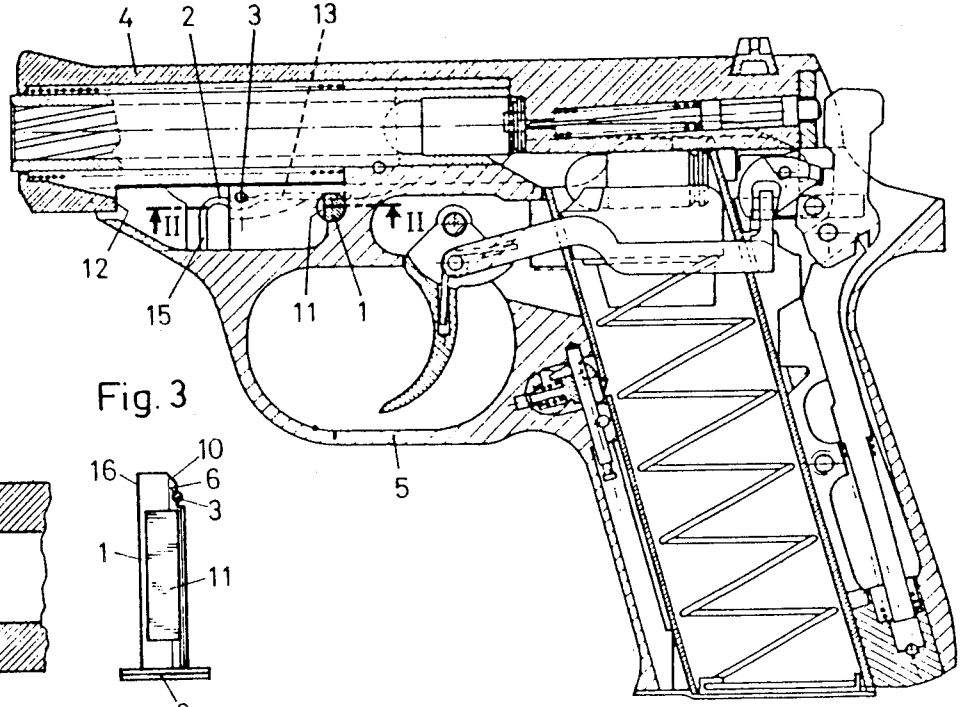
Fig. 1
Fig. 3
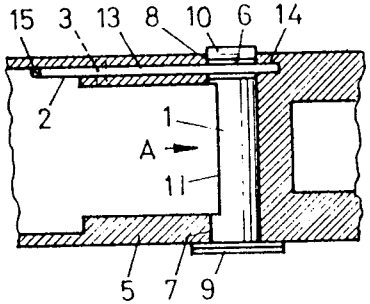
Fig. 2

SLIDE ARRESTING DEVICE AT A HANDGUN

BACKGROUND OF THE INVENTION

1. Field of the Invention

The present invention relates to a slide arresting device at a handgun having a slide supported and guided for a longitudinal movement along the frame of the gun.

2. Description of the Prior Art

The slide of such guns is held and guided on the frame for longitudinal movement thereupon and against a movement perpendicular thereto by guide rails formed at the slide and at the frame. The horizontal, backwards directed recoil and loading movement of the slide is limited generally by an abutment mounted to the frame. When this abutment is removed from the frame, the slide can be pulled completely backwards and thereafter lifted off the frame which, as generally known, is the procedure for disassembling such a gun.

The generally known abutments mounted to the frame of pistols are of a rather intrinsic and accordingly relatively expensive nature, adding to the overall production costs of such guns.

SUMMARY OF THE INVENTION

It is, therefore, a general object of the present invention to provide a slide arresting device at a handgun, which is simple in design, reliable in operation and easy to manipulate.

A further object of the present invention is to provide a slide arresting device at a handgun, which includes an elongate arresting pin having a recessed circumferential section and inserted in a bore arrangement of the frame, and an elongate flexible pin-locking spring supported on the frame and biassed into the recessed circumferential section, locking the elongate arresting pin against a longitudinal and rotational movement relative to the frame.

A still further object of the invention is to provide a slide arresting device having an elongate arresting pin which includes at one end a planar, flat head and at the opposite face end a chamfered section, and in which the bottom of the recessed section extends at least approximately tangentially relative to the circumference of the arresting pin.

A further object is to provide a slide arresting device, in which the elongate arresting pin includes a planar jacket section which in the inserted and locked state of the arresting pin is aligned with and faces an abutment surface at the slide of the gun, whereby the extent of the recoil movement of the slide relative to the frame of the gun is limited.

BRIEF DESCRIPTION OF THE DRAWING

The present invention will be better understood and objects other than those set forth above will become apparent when consideration is given to the following detailed description thereof. Such description makes reference to the annexed drawings, wherein FIG. 1 illustrates a cross-section through a handgun;

FIG. 2 is a section along line II—II of FIG. 1; and

FIG. 3 is a view of the arresting pin in the direction of the arrow A of FIG. 2.

DESCRIPTION OF THE PREFERRED EMBODIMENT

FIG. 1 illustrates a section through a handgun for the purpose of a mere and general illustration thereof. Only those structural members are identified by reference numerals and described hereinafter that are of importance to understand the present invention. The remaining main parts are generally known to the person skilled in the art.

An arresting pin 1 is inserted in a bore arrangement formed in the frame 5 of the gun, and consisting of two bores 7 and 8. This arresting pin 1 includes a planar, flat head 9, resting against a surface section of the frame 5 at the bore 7. At its end opposite to the planar, flat head 9, the arresting pin 1 has a recessed circumferential section 6, of which the bottom extends at least approximately tangential relative to the circumference of the pin. The face end of the arresting pin 1 is, furthermore, provided with a chamfered section 10 as specifically illustrated in FIG. 3.

Furthermore, an approximately "L"-shaped pin locking spring 2 is provided. The longer leg 13 of the "L"-shape, see hereto specifically FIG. 1, rests in the mentioned recessed circumferential section 6 of the arresting pin 1, and ends in a recess 14 in the frame 5. The shorter leg 15 of the "L"-shape abuts bluntly an area of the frame 5. Furthermore, a spring-retaining pin 3 is held in the frame 5 and lies, based on the illustration of FIG. 1, on top of the longer leg 13 of the pin locking spring 2. The location of this spring-retaining pin 3 and the shape of the pin locking spring 2 are selected such that the spring 2 is elastically urged and held in the recess 6 of the arresting pin 1.

The arresting pin 1 includes, furthermore, a planar jacket section 11, facing an abutment surface 12 at the slide 4. This planar jacket section 11 acts accordingly to limit the backward recoil movement of the slide 4 after a shot has been fired or a loading movement is being made, during which, as is generally known, the slide 4 is pulled backwards on the frame 5 of the gun.

The Figures illustrate the arresting pin 1, ie the slide arresting device together with the gun in the assembled state.

In order now to remove the arresting pin 1 such that the slide 4 can be pulled back and off the frame 5, the arresting pin 1 is gripped by eg an appropriate tool at its planar, flat head 9 and rotated by eg 90 or 180°. Conclusively, the section of the pin locking spring 2, which has been lying in the recessed, circumferential section 16, is sort of lifted such that it comes to lie on a circumferential point of the arresting pin 1 remote from the recessed circumferential section, eg at the point identified in FIG. 3 by the reference numeral 16. Accordingly, the arresting pin 1 can be pulled out of the frame 5 of the gun, such to allow the above mentioned disassembling by initially pulling the slide 4 back.

If for the assembling of the gun the arresting pin 1 is to be re-inserted through the bores 7 and 8 of the frame 5, the longer leg 13 of the pin locking spring 2 quite obviously blocks the bore 8. In order to move this spring 2 out of the way, the arresting pin 1 is equipped with the earlier mentioned chamfered section 10, over which the spring 2 can slide upwards when the pin 1 is inserted and thereafter snap into the recess 16.

Accordingly, a quite simple structure is provided for arresting the slide on the frame of a handgun, which at the same time forms an abutment, limiting the travel during the recoil or loading movement of the slide 4.

While there is shown and described a present preferred embodiment of the invention, it is to be distinctly understood that the invention is not limited thereto, but may be otherwise variously embodied and practiced within the scope of the following claims.

I claim:

1. A slide arresting device for a handgun having a slide supported and guided for longitudinal movement along a frame of the gun, said slide arresting device comprising:

an elongate arresting pin for insertion in a bore of a frame of a handgun and having a recessed circumferential section;

and an elongate flexible pin-locking spring for support on said frame, biasing into said recessed circumferential section, and locking said elongate arresting pin against longitudinal and rotational movement relative to said frame;

said elongate arresting pin comprising at one end a planar, flat head and at an opposite end a chamfered section a bottom of which extends at least approximately tangentially relative to the circumference of said elongate arresting pin, and a planar jacket section which, in the inserted and locked state of said elongate arresting pin, is aligned with and faces an abutment surface at a slide of a gun, whereby the extent of the recoil movement of the slide relative to the frame of the gun is limited.

2. The slide arresting device of claim 1, in which said pin locking spring consists of a substantially L-shaped elastically flexible wire, of which the longer leg projects into a recess in the gun frame and the face end of the shorter leg rests bluntly against the frame, and in which a spring-retaining pin is provided, extending perpendicularly to said pin locking spring and fixedly supported in the frame, which spring-retaining pin contacts said longer leg of the locking spring at a point between the bend of the L-shape and the area of contact between the longer leg and the arresting pin but remote of the latter, which spring-retaining pin rests against a generatrix of the locking spring extending diametrically opposite of the generatrix extending through the point of contact between the locking spring and the arresting pin.

* * * * *